US007887354B2

(12) United States Patent
Holliday

(10) Patent No.: US 7,887,354 B2
(45) Date of Patent: Feb. 15, 2011

(54) THREAD LOCK FOR CABLE CONNECTORS

(76) Inventor: Randall A. Holliday, 1860 Mallard Dr., Broomfield, CO (US) 80020

( * ) Notice: Subject to any disclaimer, the term of this patent is extended or adjusted under 35 U.S.C. 154(b) by 0 days.

(21) Appl. No.: 12/537,972

(22) Filed: Aug. 7, 2009

(65) Prior Publication Data

US 2010/0035457 A1 Feb. 11, 2010

Related U.S. Application Data

(60) Provisional application No. 61/188,623, filed on Aug. 11, 2008.

(51) Int. Cl.
*H01R 4/38* (2006.01)

(52) U.S. Cl. ..... 439/321; 439/277

(58) Field of Classification Search ..... 439/321, 439/322, 320, 411, 585, 584, 277
See application file for complete search history.

(56) References Cited

U.S. PATENT DOCUMENTS

| | | | | |
|---|---|---|---|---|
| 184,835 | A * | 11/1876 | Champion | 411/304 |
| 1,809,620 | A * | 6/1931 | Cole | 411/303 |
| 2,942,640 | A * | 6/1960 | Lundeberg | 411/302 |
| 3,778,535 | A | 12/1973 | Forney, Jr. | |
| 4,258,942 | A | 3/1981 | Viola | |
| 4,305,608 | A | 12/1981 | Stuemky et al. | |
| 4,307,926 | A | 12/1981 | Smith | |
| RE31,995 | E | 10/1985 | Ball | |
| 4,603,888 | A | 8/1986 | Goodall | |
| 4,676,573 | A * | 6/1987 | Norman | 439/318 |
| 4,759,237 | A | 7/1988 | Fauchet et al. | |
| 5,267,758 | A | 12/1993 | Shah et al. | |
| 5,317,799 | A | 6/1994 | Chapman et al. | |
| 5,501,616 | A | 3/1996 | Holliday | |
| 5,667,405 | A * | 9/1997 | Holliday | 439/585 |
| 5,692,863 | A | 12/1997 | Louw | |
| 7,114,970 | B2 | 10/2006 | Head | |

* cited by examiner

*Primary Examiner*—Phuong K Dinh
(74) *Attorney, Agent, or Firm*—The Reilly Intellectual Property Law Firm, P.C.; John E. Reilly; Ellen Reilly

(57) ABSTRACT

In a coaxial cable connector assembly, having a connector sleeve or retaining end of a coaxial cable and a coupling member between the sleeve and a terminal port to draw the sleeve into engagement with an end of the port, an internal locking device is made up of an annular groove formed along an internally threaded portion of the coupling member and a compressible washer which is pre-assembled in the groove, the coupling member having a male threaded end complementary to the internally threaded portion and washer so that when advanced through the internally threaded portion and washer will increase the torque loading between the coupling member and sleeve to resist accidental loosening or disengagement therebetween. The washer is an endless ring and formed in varying cross-sections for insertion into close-fitting engagement with the groove and may be utilized alone or in combination with seal and spring members at the interface between the male threaded end of the port and the internally threaded portion of the coupling member. In a modified form, an endless compressible liner is employed in place of the washer and groove to resist accidental loosening or disengagement between the post and coupling member.

18 Claims, 8 Drawing Sheets

10
12
34
26
32
28
30
56
P
C
20
14
22
16
S
24
40

J
B
F
D
I 51
44
52
48
50
42
46

C
12
10
S
28
22

J
B
14
S
28
60
P
I
62
64
66
65
65
66
65
60
42

30
60
56

J
B
129
114
120
118
111
110
117
112
122
113
126
115
132
146
115'
148
144
140
146
152
150

C
129
124
122
134
136
132
128
56
P
150
115'
56

THREAD LOCK FOR CABLE CONNECTORS

CROSS REFERENCE TO RELATED APPLICATION

The present application is a utility conversion of provisional patent application Ser. No. 61/188,623 filed 11 Aug. 2008, Thread Lock for Cable Connectors and is incorporated by reference herein.

BACKGROUND AND FIELD

The following relates to thread locks and more particularly relates to novel and improved locking devices for maintaining the necessary resistance between male and female threaded connectors in a simplified and dependable manner. The devices are conformable for use in a wide range of applications but in particular as internal locking devices for use with coaxial cable connectors for threaded attachment to TV or VCR terminals as well as for splice connectors and splitters.

I have devised many different forms of coaxial cable connectors to establish sealed engagement between the coaxial cable and connector end as well as to secure a positive coupling between the connector and terminal port while avoiding the use of separate seals or materials. Typical examples may be found in U.S. Pat. Nos. 5,501,616 and 5,667,405. In many applications, however, the connector is not only exposed to vibrational forces which tend to loosen the threaded connection between the members, such as, between the coupling nut and port but must be capable of preventing the entry of moisture via the threading or nut at the interface between the connector body and port inwardly of the seal for most effective signal transmission into the port from the cable, and to minimize radiation leakage.

Accordingly, there is a need for an internal locking device between threaded members which alone or in combination with a seal will increase the torque required to loosen or release the threaded portions, for example, when subjected to vibration; and further to avoid the need for boots on signal splitters and similar types of outdoor connections.

SUMMARY

It is therefore an object to provide for a novel and improved thread lock for maintaining a substantially constant resistance between male and female connectors in order to prevent loosening or separation under long periods of use and is capable of withstanding vibrational forces.

Another object is to provide a thread lock which is conformable for use with threaded couplings in a wide range of applications but is particularly adaptable for use with coaxial cable connectors for threaded attachment to TV or VCR terminals as well as for splice connectors and splitters.

It is another object to provide a novel and improved coaxial cable connector which is conformable for use with different sized cables and is movable into uniformly sealed engagement with one end of the cable while at the same time effecting sealed engagement between the connector fitting and port so as to establish a weather-tight seal when exposed to the elements and prevent accidental loosening or disengagement between the connector and port.

In one embodiment, a cable connector is provided for connection to a male threaded end of a port wherein a connector sleeve is adapted to receive an end of a cable, and a coupling nut includes an internally threaded portion to receive the male threaded end, the improvement comprising an annular groove formed between opposite ends of the internally threaded portion; a compressible washer inserted in the groove including an inner peripheral face in substantial alignment with inner peripheral edges of the internally threaded portion; and wherein threaded advancement of the male threaded end through the internally threaded portion into engagement with the washer is operative to increase the torque loading between the coupling nut and the sleeve whereby to resist accidental loosening or disengagement between the port and the coupling nut.

In another embodiment, a coaxial cable connector is adapted for connection to a terminal port wherein a coupling nut is provided with an internally threaded portion along its greater length to receive a male threaded end portion of the port, the improvement comprising an annular groove of generally rectangular cross-sectional configuration interrupting the internally threaded portion at a location relatively near an inner end of the internally threaded portion, a compressible washer inserted in the groove including an inner peripheral surface in substantial alignment with radially inner edges of the internally threaded portion, and the male threaded end being rotatable through the internally threaded portion and the washer, the washer being operative to increase the frictional resistance between the coupling nut and sleeve whereby to resist accidental loosening or disengagement between the port and the coupling nut.

In still another embodiment, in a cable connector for connection to a male threaded end of a port wherein a connector sleeve is adapted to receive an end of a cable, and a coupling nut includes an internally threaded portion to receive the male threaded end, the improvement comprises an annular groove formed intermediately between opposite ends of the internally threaded portion, a compressible washer inserted in the groove including an inner peripheral face in substantial alignment with inner peripheral edges of the internally threaded portion wherein threaded advancement of the male threaded end through the internally threaded portion into engagement with the washer is operative to increase the torque loading between the coupling nut and the sleeve whereby to resist accidental loosening or disengagement between the port and the coupling nut, and an annual seal is disposed between the connector sleeve and the coupling nut.

Another modified form in a coaxial cable connector for connection to a terminal port wherein a coupling nut is provided with a spiral, internally threaded portion along its greater length to receive a complementary male threaded end portion of said port, a compressible liner having a generally corrugated cross-section includes outer peripheral teeth conforming to the pitch of the teeth of the internally threaded portion and inner peripheral teeth conforming to the pitch of the teeth of the male threaded portion, the liner extending the greater length of the internally threaded portion, and the male threaded end being rotatable through the internally threaded portion and into compressible engagement with the liner, the liner being operative to increase the frictional resistance between the coupling nut and sleeve whereby to resist accidental loosening or disengagement between the port and the coupling nut.

In the embodiments described, most desirably the annular groove is located relatively near the inner end of the internally threaded portion and away from the entrance end, and the male threaded end is movable beyond the washer into flush engagement with a bearing surface at an inner end of the nut or leading end of the connector sleeve. In further variations of the embodiments described, the washer may include an outer peripheral undulating wall surface defined by alternating ribs and grooves. In addition, an annual flange may extend from an inner peripheral edge of the washer toward a bearing surface at an end of the connector sleeve or nut. Still further, a spring member may be interposed between a bearing surface adjacent to an inner end of the internally threaded portion of the nut or the end of the connector sleeve.

The above and other objects, advantages and features will become better appreciated and understood from a consideration of the following detailed description of the different embodiments when taken together with the accompanying drawings in which:

DETAILED DESCRIPTION OF THE EMBODIMENTS SHOWN

Figures 1, 1A, 2, 2A:
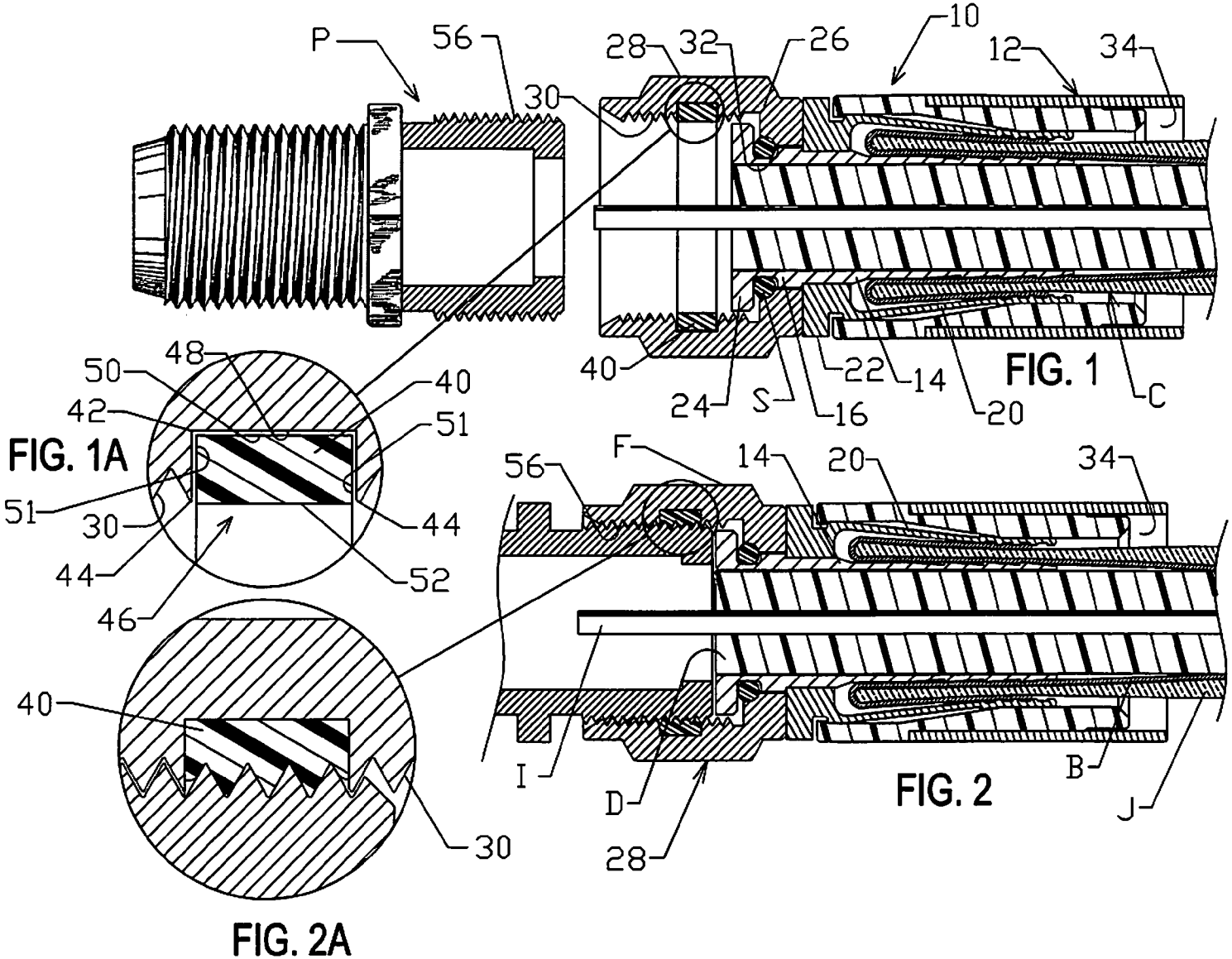
FIG. 1 is an exploded longitudinal section view of one embodiment of thread lock mounted in a coaxial cable connector assembly.
FIG. 1A is an enlarged view in detail of the thread lock.
FIG. 2 is a longitudinal section view of the embodiment shown in FIG. 1 with the parts assembled.
FIG. 2A is an enlarged view in detail of the thread lock shown in FIG. 2.
Figures 3, 3A, 4, 4A:
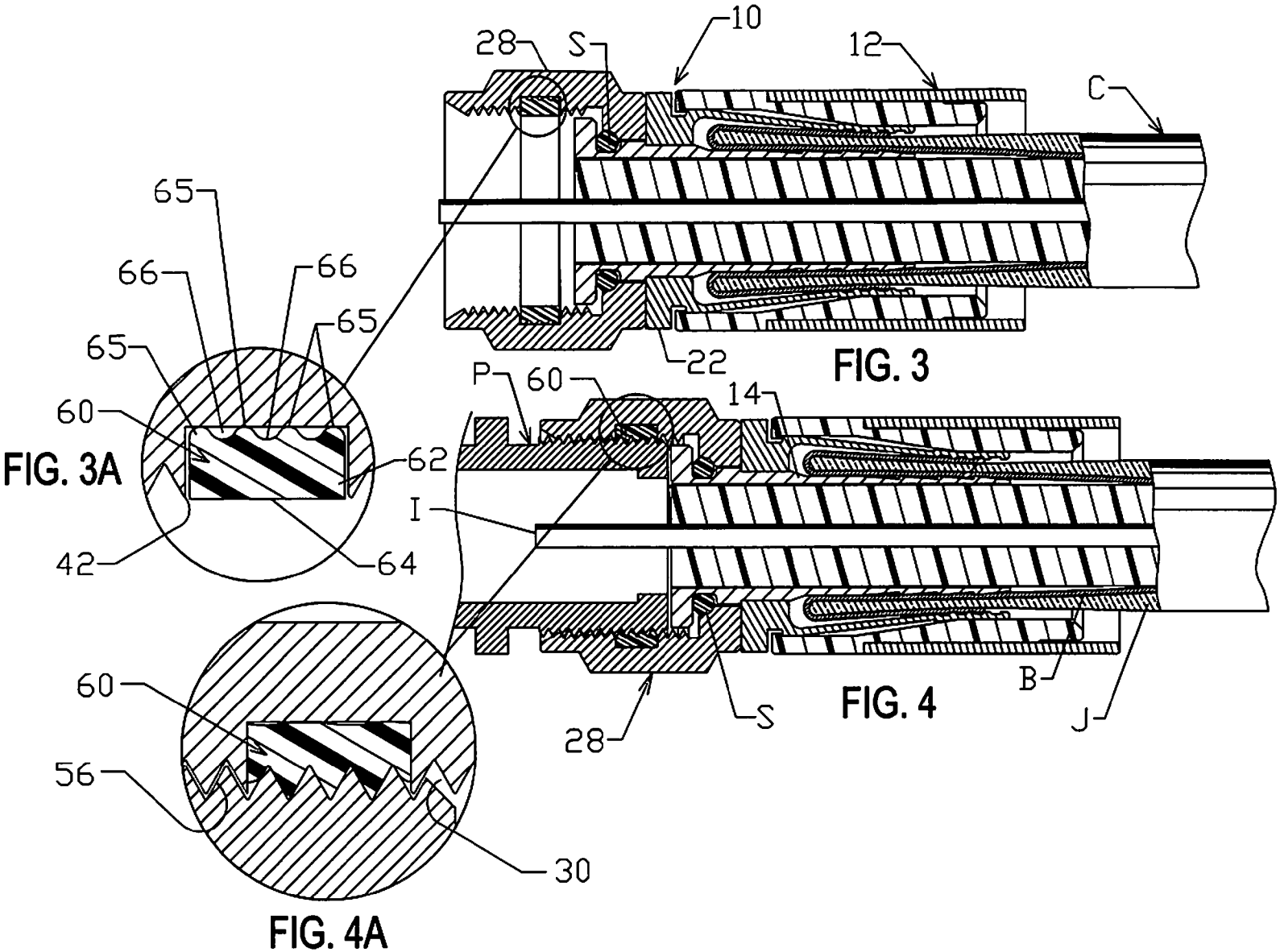
FIG. 3 is a longitudinal section view of another embodiment of a thread lock.
FIG. 3A is an enlarged view in detail of the thread lock embodiment of FIG. 3.
FIG. 4 is a longitudinal section view of the connector assembly with thread lock as shown in FIG. 3 when assembled onto a port.
FIG. 4A is an enlarged view in detail of the thread lock shown in FIG. 4.

In one embodiment, an end connector 10 is a standard F-connector having a coupling nut 28 for threaded connection to an F81 splice connector or port P. The connector 10 also may be of the type including a pre-installed compression ring 12. The main body of the connector 10 is comprised of an inner sleeve 14 including a ferrule 16 at its forward end; and an outer spaced concentric sleeve 20 is coextensive with the inner sleeve 14 and has a forward enlarged end 22 which bears against an external shoulder 24 on the ferrule 16 as well as the reduced end 26 of the nut 28, the nut being internally threaded at 30 to receive a port P on the end of a TV or VCR terminal, not shown. An O-ring seal S is captured in a groove 32 between the shoulder 24, reduced end 26 and the ferrule 16.

The inner and outer sleeves 14 and 20 form an annular space 34 therebetween for insertion of a coaxial cable C in a well-known manner, and the cable C is made up of an inner conductor pin I, dielectric insulator D, outer braided conductor B and an outer insulating jacket J which is composed of rubber or similar insulating material. The cable C is prepared for insertion into the space 34 by removing a first length of the jacket J from the cable end and removing a second shorter length of the braided conductor B and dielectric insulator D from the pin I at the cable end to expose an end of the pin I. A portion of the conductor B which extends beyond the jacket J is folded over the jacket J prior to insertion into the space 34.

In order to tightly secure the port P to the nut 28, an annular lock washer 40 is inserted into an annular groove 42 which is formed at a predetermined section or location on the internally threaded portion 30 toward the reduced end 26. In one aspect, the groove 42 is of generally rectangular configuration and slightly deeper than the depth of the threaded portion 30. Thus, the groove 42 has straight sidewalls 44 extending away from open end 46 and a straight back or outer wall 48 extending between the sidewalls 44. The washer 40 is of a cross-sectional configuration and size corresponding to or slightly less than the groove 42 including an outer flat wall 50, opposite sidewalls 51 and an inner flat wall surface 52. The washer 40 is of a width to substantially correspond to the width of the groove 42 so as to be firmly seated in the groove 42, and the inner wall surface 52 is of a diameter corresponding to the inner diameter of the threads 30.

The washer 40 is composed of a material having sufficient resiliency as to permit it to be compressed enough to clear the inner diameter of the threaded portion 30 until it is aligned with the groove 42 then expand to become tightly wedged into the groove 42, as illustrated in the detailed view of FIG. 1A. Materials suitable for use in the makeup or construction of the lock washer are plastic or rubber materials, such as, the olefin polyethylene compositions which have sufficient friction to resist slippage or relative rotation once seated in the groove 42 but which will enable the external threads 56 on the port P to threadedly advance along the inner wall surface 52 until the leading end of the post P has advanced beyond the wall surface 52, as shown in detail in FIG. 2A. Typically, the port P is fixed against rotation and the coupling nut 28 is threaded by hand onto the port P after the lock washer 40 has been inserted into the groove 42. When threaded by hand, there will be a noticeable increase in torque resistance as the washer 40 moves into engagement with the threads 56, and this resistance will continue for several turns until the leading end of the port P abuts the shoulder 24 at the end of the inner sleeve 14. In the alternative, a hand wrench may be utilized to engage the flats F on the coupling nut 28 to assemble the connector assembly 10 onto the port P. Particularly in outdoor applications, it is desirable to utilize a hand wrench or similar tool to at least complete the assembly of the coupling nut 28 onto the port P so as to compress the O-ring seal S between the shoulder 24 and reduced end 26. In this relation, it is desirable in outdoor applications to utilize a material for the lock washer 40 which has sealing capability so as to establish an effective seal between the threaded members.

In a modified form of thread lock, as shown in FIGS. 3, 3A, 4 and 4A, like parts are correspondingly enumerated to those of FIGS. 1, 1A, 2 and 2A. Instead of utilizing the lock washer 40, a lock washer 60 is made up of an annular body of a width slightly less than the width of the groove 42, the washer 60 having opposite sidewalls 62, inner flat wall surface 64 and an outer undulating wall surface defined by alternating rounded ribs 65 and grooves 66. Once again, the washer 60 is composed of a resilient material which can be compressed or contracted to clear the inner diameter of the threads 30 until it becomes aligned with the groove 42 and then is free to expand into the groove 42 as illustrated in detail in FIG. 3A. The washer body is of a depth or thickness such that the diameter of the inner wall surface 64 corresponds to the inner diameter of the threads 30 but the washer can more freely expand radially outwardly under the outward pressure of the threads 56 on the port P as well as to spread into engagement with the sidewalls.

Figures 5, 5A, 6, 6A:
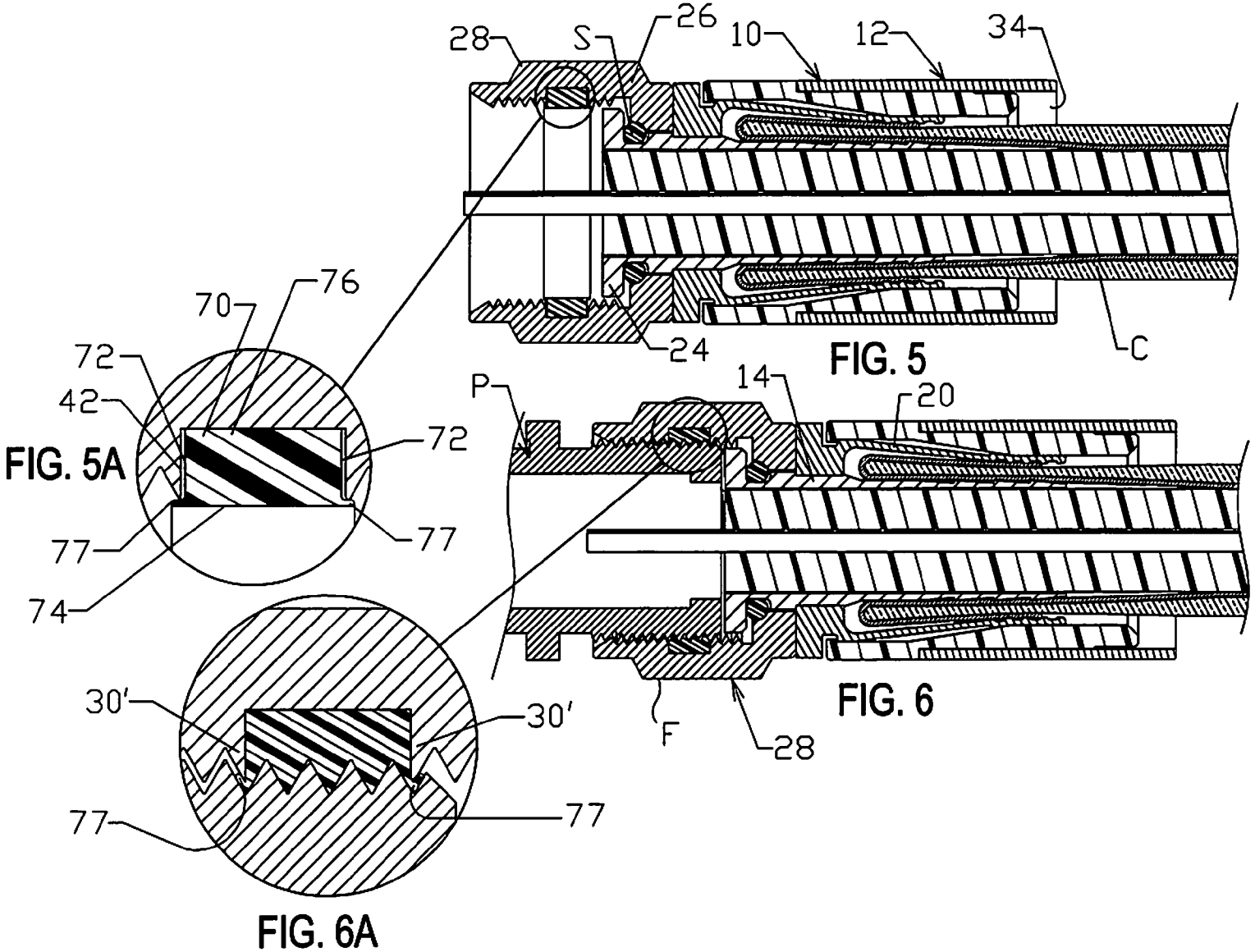
FIG. 5 is a longitudinal section view of another connector assembly containing a modified form of a thread lock.
FIG. 5A is an enlarged view in detail of the thread lock shown in FIG. 5.
FIG. 6 is a longitudinal section view with the parts assembled of the connector assembly shown in FIG. 5.
FIG. 6A is an enlarged view in detail of the embodiment of thread lock illustrated in FIGS. 5 and 6.
Figure 7:
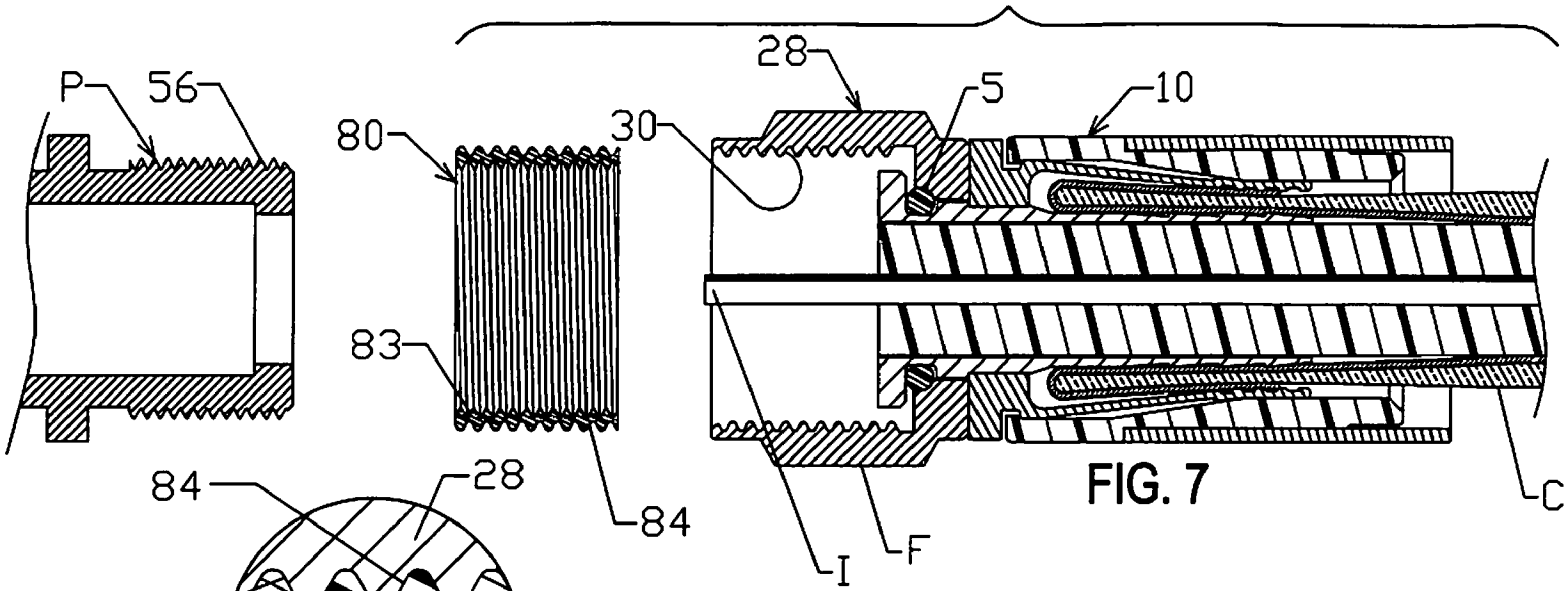
FIG. 7 is an exploded longitudinal section view of a connector assembly with still another form of thread lock prior to assembly.

Another modified form of thread lock is illustrated in FIGS. 5, 5A, 6, and 6A wherein a lock washer 70 is sized for close-fitting insertion into the groove 42. Again, like parts to those shown in FIGS. 1, 1A, 2 and 2A are correspondingly enumerated. The washer 70 is of generally rectangular configuration having opposite sidewalls 72, inner flat wall surface 74 and an outer flat wall surface 76. However, the inner wall surface 74 projects beyond the sidewalls 72 for a limited distance to define relatively thin-walled flanges 77 around the inner periphery of the washer 70. The washer 70 is also composed of a material which can be compressed or contracted to clear the inner diameter of the threads 30 until it is aligned with the groove 42 and then expands into the groove 42 as shown in FIG. 6A. The washer 70 is of a depth or thickness such that the diameter of the inner wall 74 is slightly less than the inner diameter of the threads 30 so that the flanges 77 are in overhanging relation to the tooth segments 35 flanking opposite sides of the groove 42. Accordingly, when the nut 28 is threaded onto the port P, the threads 56 will advance to the fully threaded position shown in FIGS. 6 and 6A thereby causing the flanges 77 to be bent over the tooth segments 30' and thereby assure a greater sealing surface area between the threads 56 and lock washer 70.

Figure 8:
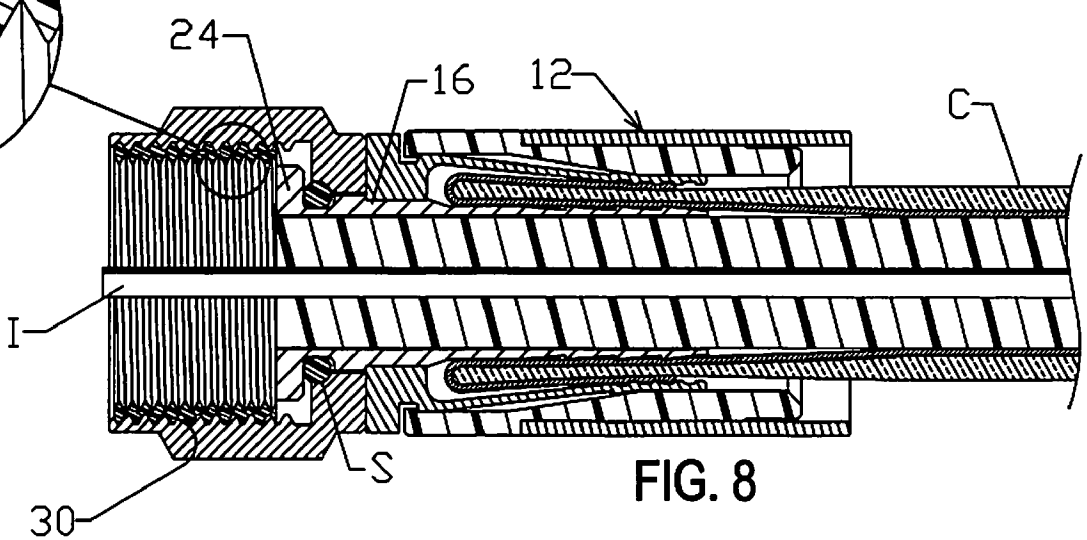
FIG. 8 is a longitudinal section view of the connector and thread lock shown in FIG. 7 in assembled relation prior to connection to a port.
Figure 8A:
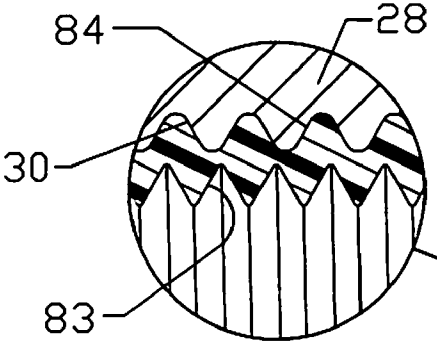
FIG. 8A is an enlarged view in detail of the thread lock of FIGS. 7 and 8 prior to assembly onto a port.
Figures 9, 9A:
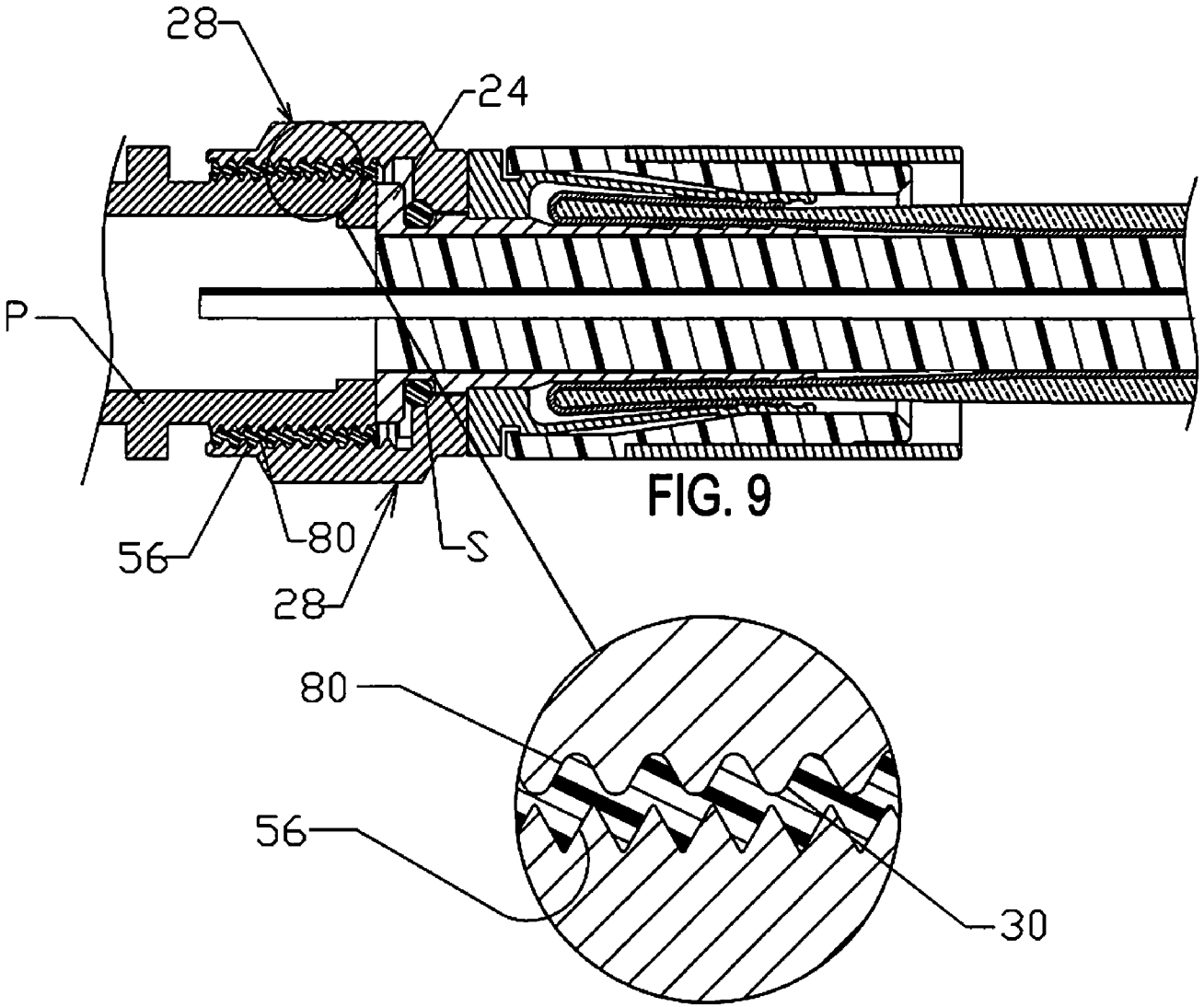
FIG. 9 is a longitudinal section view of the embodiment of thread lock shown in FIGS. 7 and 8 after assembly onto a port.
FIG. 9A is an enlarged view in detail of a portion of the thread lock embodiment shown in FIG. 9.

Still another modified form is illustrated in FIGS. 7, 8, 8A, 9, and 9A in which a thread lock 80 is made up of a thin-walled annular liner having inner and outer teeth 83 and 84, respectively, the outer peripheral teeth 84 being complementary to the inner threading 30 on the nut 28 and to the male threaded end 56 of the port P. Again, like parts to those shown in FIGS. 1, 1A, 2 and 2A are correspondingly enumerated. The liner 80 is of a length substantially corresponding to the length of threaded portion 30 and can be contracted and advanced through the nut 28 until it reaches a position adjacent to the shoulder 24 on the ferrule 16, as shown in FIGS. 8 and 8A, then released into press-fit engagement with the threads 30. When the port P is threadedly advanced through the coupling nut 28, the threads 56 on the port P will compress the liner 80 and, for this purpose, the port P is slightly undersized with respect to the nut 28 so that the port P can be threaded beyond the liner 80 until its leading end engages the shoulder 24, as shown in FIGS. 9 and 9A. As best seen from FIG. 8A, the pitch of the teeth making up the threads 30 is greater than that of the teeth making up the threads 56; and the teeth on the threads 30 are rounded as shown in FIG. 8A to afford more uniform clearance between the threads 30 and 56 as the port P is advanced through the nut 28.

FIGS. 10, 10A, 11, and 11A illustrate the utilization of a lock washer 40 in a groove 42 as shown in FIGS. 1-2A mounted in a coupling nut 90 of a modified form of coaxial cable connector 92, such as, of the type illustrated in U.S. Pat. No. 5,667,405, assigned to the Assignee of this application. As in the patented connector, an O-ring 93 is sized to fit within the nut 90 between the end of the threads 30 and external shoulder 94 at the end of the inner sleeve 96. An outer spaced concentric sleeve 97 forms an annular space with the inner sleeve 96 for insertion of a cable C in the same manner as previously described with reference to FIGS. 1-2A. However, crimping of the sleeve 97 is done with the use of a crimping tool such as that disclosed in U.S. Pat. No. 5,292,508.

Figures 10, 10A, 11, 11A:
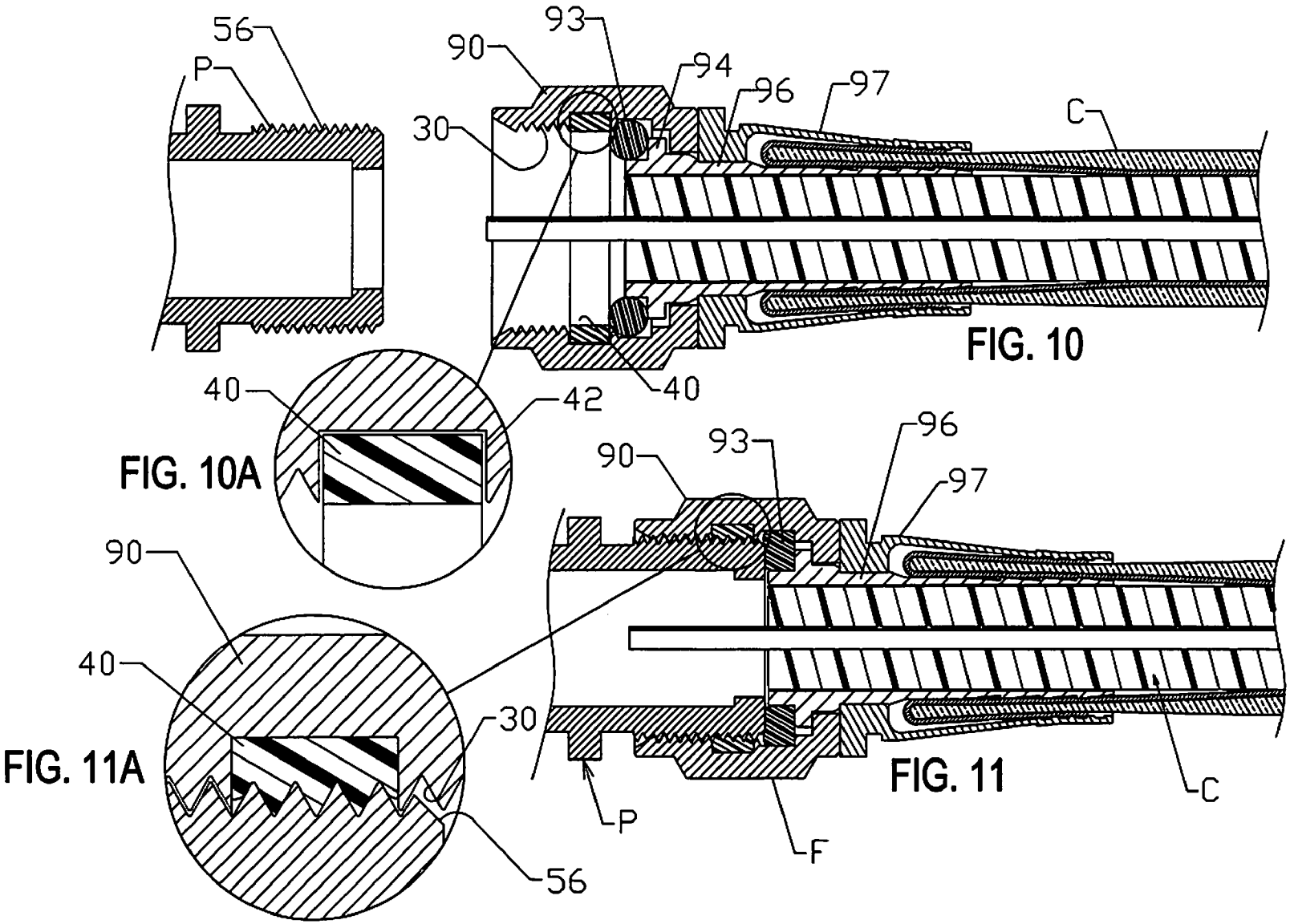
FIG. 10 is an exploded, longitudinal section view of the embodiment of thread lock illustrated in FIGS. 1 and 2 after installation into a modified form of connector assembly.
FIG. 10A is an enlarged view in detail of the thread lock assembly shown in FIG. 10.
FIG. 11 is a longitudinal section view of the connector assembly of FIG. 10 assembled onto a port.
FIG. 11A is an enlarged view in detail of a portion of the thread lock assembly shown in FIGS. 10 and 11.

When the nut 90 is threaded onto the port P the threads 56 will compress the lock washer 40 in the same manner as described with reference to FIGS. 1-2A, and the male threaded end 56 of the port P will move into direct sealed engagement with the O-ring seal 93, as illustrated in FIG. 11.

Referring to FIGS. 12-15 there is illustrated a cable connector assembly of the type illustrated in my earlier U.S. Pat. No. 5,667,405 and wherein a connector assembly 110 is of a type specifically adapted for outdoor use and has an inner connector sleeve or post 111 including a sleeve body 112 at its forward end, an external shoulder or flange 113, and a rearward extension 114 of reduced diameter and wall thickness in relation to the sleeve body 112. An outer sleeve 116 has a body 117 with an internal flange or shoulder 118 in surrounding relation to the sleeve body 112, and a rearward extension 120 tapers rearwardly away from the body 117 in outer spaced concentric relation to the inner sleeve extension 114 so as to form an annular space for insertion of conductor layer B and the jacket J of the coaxial cable C. The extension 120 is of increased thickness as at 117' at its juncture with the shoulder 118. A compression member 129 is actually advanced over the rearward extension 120 to crimp the rearward extension 120 into engagement with the outer jacket J and layer B in a well known manner.

A coupling nut 122 at the forward end of the connector 110 has a radially inwardly directed shoulder 124 interposed between the external shoulder 113 of the inner sleeve body 112 and the outer sleeve body 117 and which normally is freely rotatable with respect to the inner and outer sleeve members 111 and 116. The fastener 122 is internally threaded as at 126 along its greater length and is generally hexagonal configuration with external flats 128 to receive a hand wrench or other tool in threading the nut 122 onto the port P of a terminal.

A seal 132 is inserted between the external shoulder 113 of the sleeve 112, coupling nut 122 and annular end portion 134 of the port P. The annular end portion 134 has a flat end surface in facing relation to the forward end wall portion 115 of the connector body 112. The forward end wall portion 115 defines a forward annular extension of the radially inner portion of the flange 113 and terminates in an annular end surface provided with an outer peripheral groove 115' in facing relation to the annular end of the port P. In turn, the seal member 132 is sized to fit snugly within an external groove 136 behind the shoulder 113 and the external surface of the post 111. The seal member 132 is in the form of an O-ring which is compressed between the groove 136 and shoulder 124 when the coupling nut 128 is tightened by threading onto the port P, as shown in FIG. 13.

Figures 12, 12A, 13, 13A:
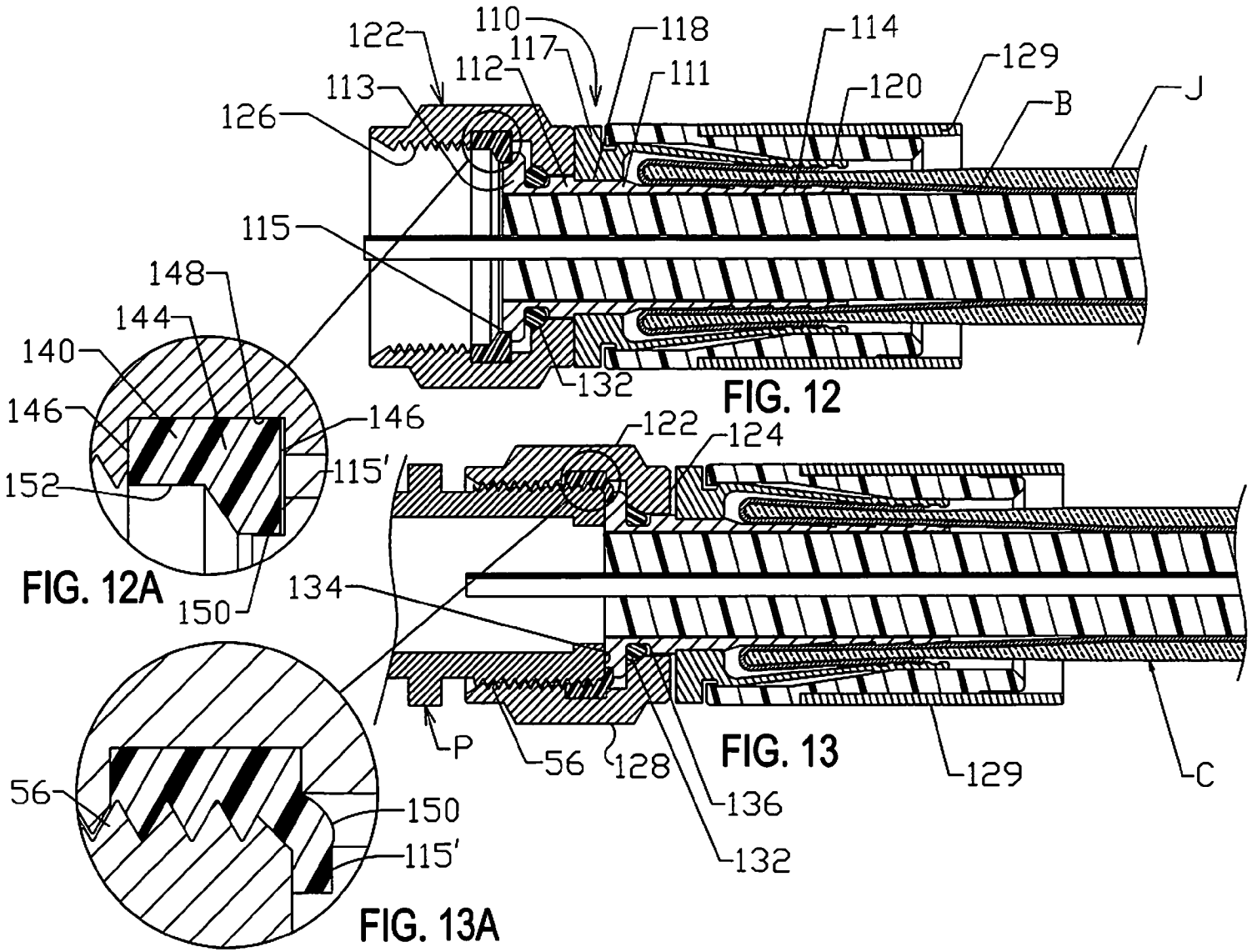
FIG. 12 is a longitudinal section view of another embodiment of thread lock installed in a groove at the end of the internally threaded portion of a coupling nut.
FIG. 12A is an enlarged view in detail shown in FIG. 12.
FIG. 13 is a longitudinal section view of the connector assembly of FIG. 12 assembled onto a port.
FIG. 13A is an enlarged view in detail of the thread lock assembly shown in FIG. 13.
Figures 14, 14A, 15, 15A:
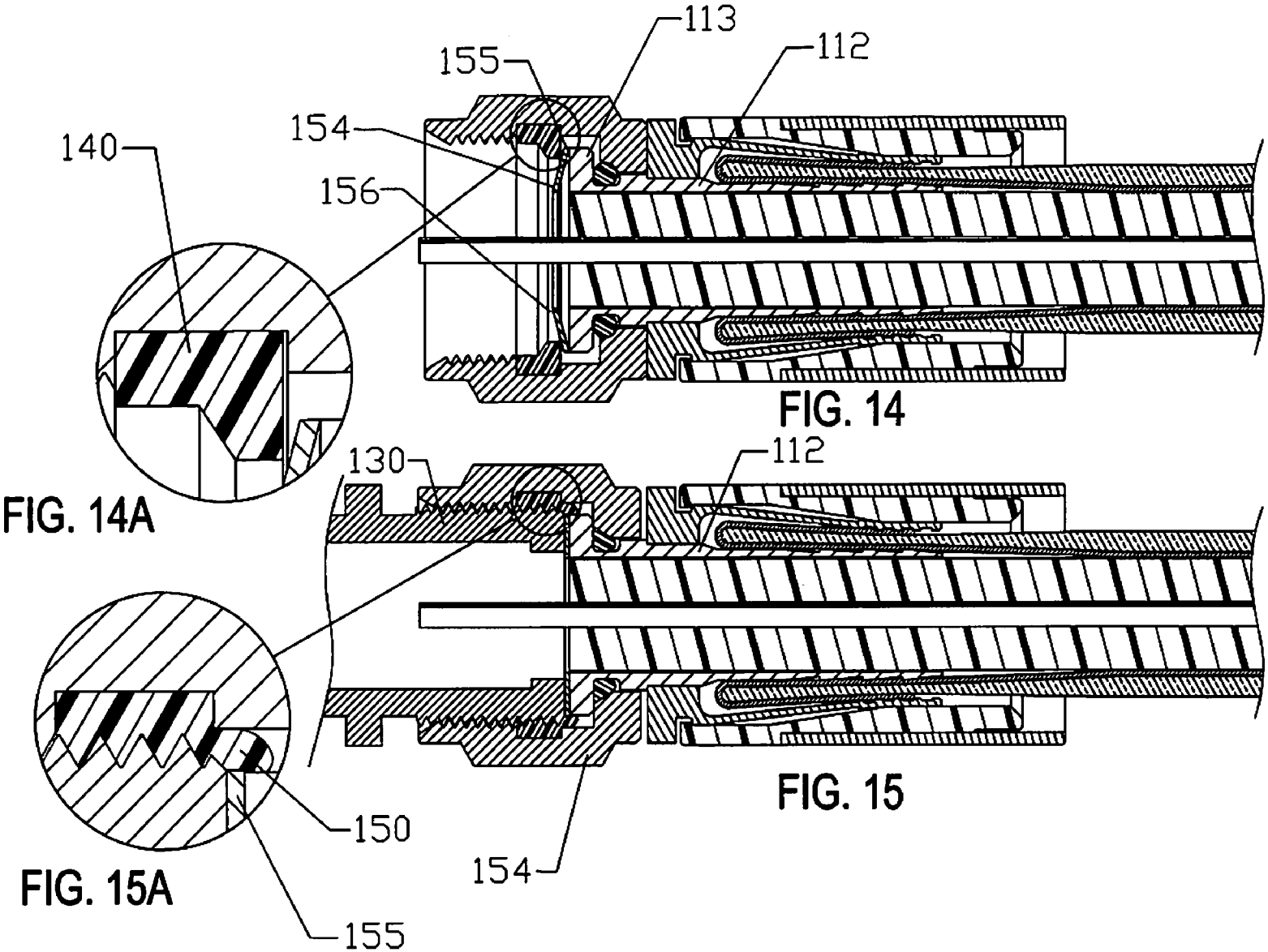
FIG. 14 is a longitudinal section view of another embodiment of thread lock employed in combination with a spring member.
FIG. 14A is an enlarged view in detail of the thread lock assembly shown in FIG. 14.
FIG. 15 is a longitudinal section view of the assembly of FIG. 14 assembled onto a port.
FIG. 15A is an enlarged view in detail of the thread lock assembly shown in FIG. 15.

A lock washer 140 is mounted in an internal groove 142 at the inner end of the internally threaded portion 126 of the coupling nut 122, as shown in detail in FIG. 12A. The washer 140 is composed of a compressible material as described with reference to the lock washer 140 of other embodiments. The washer 140 includes a main body portion 144 of generally rectangular configuration and opposite sidewalls 146 which are dimensioned for close-fitting engagement with the groove 142, and an outer flat wall surface 148 and a flange 150 at one end which protrudes radially inwardly from an inner wall surface 152. The flange 150 is mounted within the coupling nut 122 in facing relation to the flange 113 and, when the coupling nut 122 is threaded onto the externally threaded end 130 of the port will cause the flange 150 to be compressed into the configuration shown in FIG. 13A between the externally grooved portion 115' on the end wall 113 and the abutting end wall of the port P. In this manner, the lock washer 140 cooperates with the seal 132 in preventing moisture infiltration into the space between the coupling nut 122 and sleeve body 112 while assuring good electrical conductivity between the sleeve body 112 and port P.

In certain applications, the configuration and arrangement of the end wall 115 and specifically the groove 136 may be modified while maintaining the desired sealing relationship at the interface between the connector 110, coupling member 122, and the port P. For example, an annular ledge without a groove may be formed around the radially inner wall surface 136 to establish the necessary conductor path with the end surface of the post while retaining the seal in the space radially outwardly of the end wall portion 115. Nevertheless, the groove 136 is particularly effective in retaining the seal 132 in the desired relationship to the coupling nut 122 and port P.

FIGS. 14, 14A, 15 and 15A illustrate a variation of the mounting of the thread lock washer 140 of FIGS. 12 and 13 in relation to the coupling nut 122 and end wall 113 of the sleeve 112 in which a Belleville spring 154 is mounted in front of the end wall 113 so as to be in facing relation to the end surface of the male threaded end 56. Specifically the spring washer 154 is bowed in a direction such that its outer peripheral edge 155 bears against the outer peripheral edge of the wall surface 113 with the center portion 156 of the spring washer spaced away from the end of the connector sleeve 112. When the male threaded end 56 is advanced through the nut 122 and into threaded engagement with the lock washer 140 it will cause inner flange 150 to be compressed and spread outwardly to the outer edge 155 of the spring washer 154 as the leading end of the threaded end portion 130 gradually flattens out the spring washer as best seen from FIGS. 15 and 15A. In this way, the spring washer 154 will cooperate with the lock washer 140 in increasing the resistance to loosening between the complementary threaded portions and achieve increased torque loading and at the same time, O-ring 132 is compressed in the same manner as in FIGS. 12 and 13 to increase the sealing capacity on the port P as described earlier.

It is therefore to be understood that while different embodiments of invention are herein set forth and described, various modifications and changes may be made in the specific construction and arrangement of elements without departing from the spirit and scope of the different forms of thread lock disclosed herein.

I claim:

1. In a cable connector for connection of a cable to a male threaded end of a port wherein a connector sleeve is adapted to receive an end of the cable, a coupling nut includes an internally threaded portion to receive said male threaded end and a first annular seal between said sleeve and said nut, the improvement comprising:

an annular groove disposed in said internally threaded portion of said coupling nut;

a second annular seal inserted in said groove including an inner peripheral surface in substantial alignment with inner peripheral edges of said internally threaded portion; and wherein threaded advancement of said male threaded end through said internally threaded portion said second annular seal is operative to increase the torque loading between said coupling nut and said sleeve whereby to resist accidental loosening or disengagement between said port and said coupling nut and effect sealed engagement between said threaded end and said nut.

2. In a cable connector according to claim 1 wherein said groove is located relatively near an inner end of said internally threaded portion and away from an entrance end of said internally threaded portion.

3. In a cable connector according to claim 1 wherein said male threaded end is movable beyond said second annular seal into flush engagement with a bearing surface at an inner end of said nut.

4. In a cable connector according to claim 1 wherein said male threaded end is movable beyond said second annular seal into engagement with said first annular seal member at an inner end of said nut.

5. In a cable connector according to claim 1 wherein said second annular seal and said groove are of a substantially corresponding width and depth.

6. In a cable connector according to claim 1 wherein said second annular seal is inserted into close-fitting engagement with said groove.

7. In a cable connector according to claim 1 wherein said second annular seal includes an outer peripheral undulating wall surface defined by alternating ribs and grooves therein.

8. In a cable connector according to claim 1 wherein an annular flange extends from an inner peripheral edge of said second annular seal toward a bearing surface adjacent to an inner end of said internally threaded portion of said nut.

9. In a cable connector according to claim 1 wherein a Belleville spring is interposed between a bearing surface adjacent to an inner end of said internally threaded portion of said nut.

10. In a coaxial cable connector for connection of a cable to a terminal port wherein a coupling nut is provided with a spiral, internally threaded portion along its greater length to receive a complementary male threaded end and a first annular seal between said sleeve and said nut portion of said port, the improvement comprising:

an annular groove of generally rectangular cross-sectional configuration interrupting said internally threaded portion at a location relatively near an inner end of said internally threaded portion;

a compressible second annular seal inserted in said groove, including an inner peripheral surface in substantial alignment with radially inner edges of said internally threaded portion wherein said second annular seal is inserted into close-fitting engagement with said groove; and said male threaded end being rotatable through said internally threaded portion and said second annular seal, said second annular seal being operative to increase the frictional resistance between said coupling nut and sleeve whereby to resist accidental loosening or disengagement between said port and said coupling nut.

11. In a coaxial cable connector according to claim 10 wherein said male threaded end is movable beyond said second annular seal into flush engagement with a bearing surface at an inner end of said nut.

12. In a coaxial cable connector according to claim 10 wherein said male threaded end is movable beyond said second annular seal into engagement with an annular seal member at an inner end of said nut.

13. In a coaxial cable connector according to claim 10 wherein said second annular seal and said groove are of a substantially corresponding width and depth.

14. In a coaxial cable connector according to claim 10 wherein said second annular seal includes an outer peripheral undulating wall surface defined by alternating ribs and grooves therein.

15. In a coaxial cable connector according to claim 10 wherein an annular flange extends from an inner peripheral edge of said second annular seal toward a bearing surface adjacent to an inner end of said internally threaded portion of said nut.

16. In a coaxial cable connector according to claim 10 wherein a spring member is interposed between a bearing surface adjacent to an inner end of said internally threaded portion of said nut.

17. In a cable connector for connection to a male threaded end of a port wherein a connector sleeve is adapted to receive an end of a cable, a coupling nut includes an internally threaded portion to receive said male threaded end and a first annular seal between said sleeve and said nut, the improvement comprising:

an annular groove disposed intermediately between opposite ends of said internally threaded portion;

a compressible second annular seal inserted in said groove wherein said groove is disposed at an inner end of said internally threaded portion, and said second annular seal washer includes an enlarged flange at one end opposite to said internally threaded portion;

wherein threaded advancement of said male threaded end through said internally threaded portion into engagement with said second annular seal is operative to increase the torque loading between said coupling nut and said sleeve whereby to resist accidental loosening or disengagement between said port and said coupling nut.

18. In a cable connector according to claim 17 wherein a spring member is interposed between said flange and a bearing surface on an end of said connector sleeve.

* * * * *